US010053310B2

(12) United States Patent
Nishiyama et al.

(10) Patent No.: US 10,053,310 B2
(45) Date of Patent: Aug. 21, 2018

(54) SHEET FEEDING APPARATUS AND IMAGE FORMING APPARATUS

(71) Applicant: CANON KABUSHIKI KAISHA, Tokyo (JP)

(72) Inventors: Tatsuo Nishiyama, Yokohama (JP); Jumpei Nitta, Machida (JP); Fuyuto Yamashita, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/609,269

(22) Filed: May 31, 2017

(65) Prior Publication Data

US 2017/0349389 A1 Dec. 7, 2017

(30) Foreign Application Priority Data

Jun. 3, 2016 (JP) ..... 2016-112009

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01)

(58) Field of Classification Search
CPC ..... B65H 1/04; B65H 2405/1116; B65H 2405/1117; B65H 2405/1122
See application file for complete search history.

(56) References Cited

U.S. PATENT DOCUMENTS

| | | | | |
|---|---|---|---|---|
| 8,186,671 | B2 | 5/2012 | Nishiyama | |
| 8,292,290 | B2 | 10/2012 | Ishii | |
| 9,701,497 | B2 * | 7/2017 | Washino | B65H 1/266 |
| 2013/0194643 | A1 * | 8/2013 | Chen | H04N 1/00599 358/498 |
| 2014/0091513 | A1 * | 4/2014 | Ueyama | B65H 1/04 271/10.11 |
| 2016/0257508 | A1 | 9/2016 | Nishiyama | |
| 2016/0289016 | A1 * | 10/2016 | Washino | B65H 1/266 |

FOREIGN PATENT DOCUMENTS

| | | | |
|---|---|---|---|
| JP | 2004-264840 | A | 9/2004 |
| JP | 2009-155006 | A | 7/2009 |
| JP | 2011-219189 | A | 11/2011 |
| JP | 2015-143148 | A | 8/2015 |

* cited by examiner

*Primary Examiner* — David H Bollinger
(74) *Attorney, Agent, or Firm* — Fitzpatrick, Cella, Harper & Scinto

(57) ABSTRACT

A sheet feeding apparatus includes a body portion with a supporting portion to support a sheet and a feed portion to feed the sheet, a pivoting portion arranged upstream in a sheet feeding direction of the supporting portion, and a slide portion supported slidably on the pivoting portion. A first regulating portion abuts against the slide portion and regulates the slide portion from moving downstream in the sheet feeding direction, and a second regulating portion regulates a position of the sheet supported on the supporting portion. A guide portion is formed across the supporting portion and the slide portion and guides the second regulating portion between the supporting portion and the slide portion along the sheet feeding direction, with the second regulating portion moving on the supporting portion by being guided by the guide portion in a state where the second regulating portion is separated from the slide portion.

20 Claims, 20 Drawing Sheets

SHEET FEEDING APPARATUS AND IMAGE FORMING APPARATUS

BACKGROUND OF THE INVENTION

Field of the Invention

The present invention relates to a sheet feeding apparatus configured to feed sheets, and an image forming apparatus equipped with the same.

Description of the Related Art

Hitherto, image forming apparatuses such as copying machines and facsimiles are generally provided with a cassette arranged at a lower portion of the image forming apparatus and that can be drawn out from the apparatus, and storing sheets in the cassette that are fed by a feed roller. Side edge positions of sheets stored in the cassette are regulated by a side edge regulation member, and a rear edge position of the sheets is regulated by a trailing edge regulation member. The side edge regulation member and the trailing edge regulation member are respectively movably supported to correspond to the sheet sizes.

Heretofore, Japanese Unexamined Patent Application Publication No. 2004-264840 has proposed an image forming apparatus equipped with a sheet feed cover that can be opened and closed with respect to a sheet feeding unit on which sheets are supported with the aim to downsize the apparatus, and sheets can be placed on the sheet feed cover in an opened state.

According to the image forming apparatus disclosed in the above-mentioned Japanese Unexamined Patent Application Publication No. 2004-264840, in a state where a trailing edge regulation member configured to regulate a rear edge position of the sheet is provided movably on the sheet feed cover. A user first places a sheet on the sheet feeding unit and the sheet feed cover in the opened state. Then, a side edge regulation member is moved with respect to the sheet feeding unit to regulate side edge positions of the sheet, and a trailing edge regulation member is moved with respect to the sheet feed cover to regulate a rear edge position of the sheet. Thereby, the image forming apparatus performs stable feeding of sheets without causing skew feed or jamming of the sheet.

However, in a state where a small sized sheet, such as a postcard-sized sheet, is stacked, the rear edge of the sheet may not reach the position above the sheet feed cover. In that case, the trailing edge regulation member will not regulate a rear edge position of the sheet, and the feeding of the sheet becomes unstable, such that skew feed or jamming of the sheet may easily occur.

SUMMARY OF THE INVENTION

According to one aspect of the present invention, a sheet feeding apparatus includes a body portion including a supporting portion configured to support a sheet, and a feed portion configured to feed the sheet supported on the supporting portion, a pivoting portion arranged upstream in a sheet feeding direction of the supporting portion and supported pivotably between a first position and a second position with respect to the body portion, the pivoting portion being configured to support the sheet together with the supporting portion at the first position, a slide portion supported slidably on the pivoting portion, a first regulating portion configured to abut against the slide portion and regulate the slide portion from moving downstream in the sheet feeding direction, a second regulating portion configured to regulate a position of the sheet supported on the supporting portion, and a guide portion formed across the supporting portion and the slide portion, and configured to guide the second regulating portion between the supporting portion and the slide portion along the sheet feeding direction.

Further features of the present invention will become apparent from the following description of exemplary embodiments with reference to the attached drawings.

DESCRIPTION OF THE EMBODIMENTS

First Embodiment (Entire Configuration)

Figure 1:
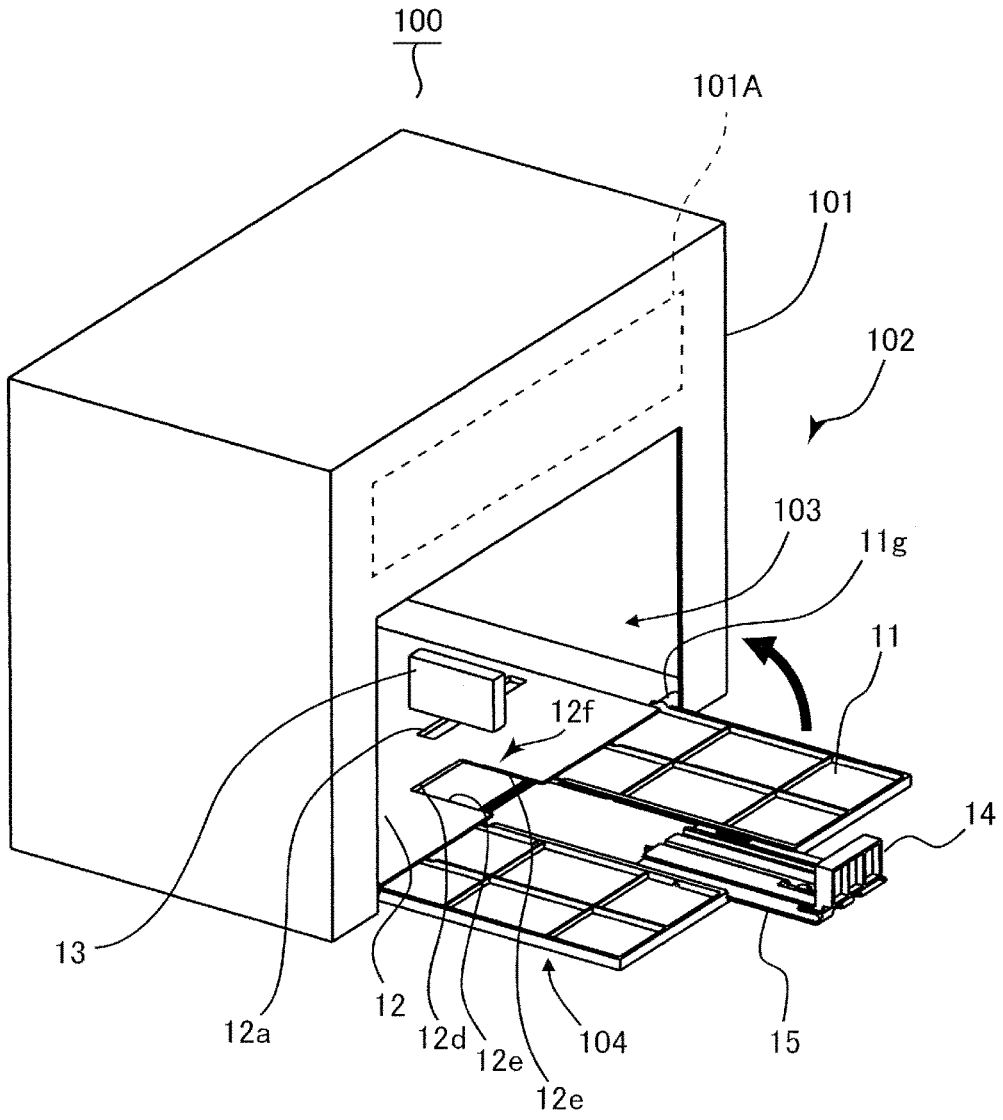
FIG. 1 is a perspective view illustrating a printer according to a first embodiment.
Figure 2:
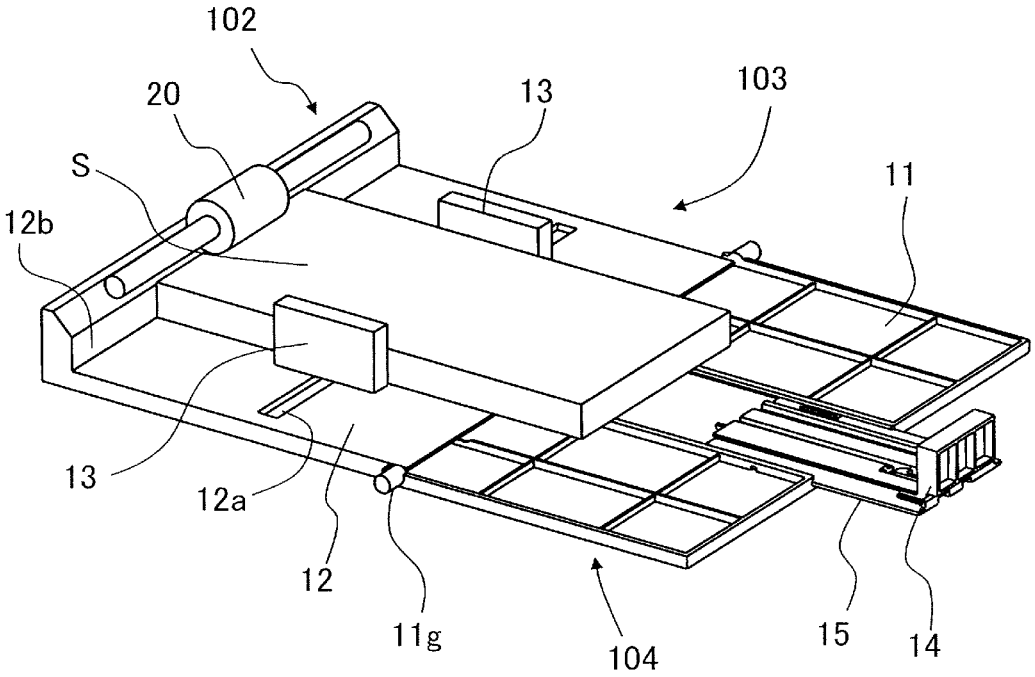
FIG. 2 is a perspective view illustrating a sheet feeding apparatus.

At first, a first embodiment of the present invention will be described. A printer 100 serving as an image forming apparatus according to the first embodiment is a laser beam printer adopting an electro-photographic system. The printer 100 includes, as illustrated in FIGS. 1 and 2, a sheet feeding apparatus 102 configured to feed sheets, and an image forming portion 101A configured to form an image on a sheet fed from the sheet feeding apparatus 102.

The image forming portion 101A adopts a well-known art in which an image is formed on a sheet by an electro-photographic system. Specifically, at first, the image forming portion 101A forms an electrostatic latent image on a photosensitive drum within a process cartridge by laser beams irradiated from a laser scanner unit, and the electrostatic latent image is visualized as a toner image by a developing unit. Next, the image forming portion 101A transfers the toner image to a sheet fed from the sheet feeding apparatus 102, and thereafter, the toner image is fixed to the sheet by a fixing unit, according to which the image is formed on the sheet.

The sheet feeding apparatus 102 includes a bottom plate 12 provided on a printer body 101 serving as a body portion, a feed roller 20 serving as a feed portion configured to feed a sheet S placed on the bottom plate 12, and a sheet feed tray 11 supported in an openable/closable state with respect to the printer body 101. The bottom plate 12 serving as a supporting portion supports a downstream side of the sheet S in the sheet feeding direction, and the sheet feed tray 11 serving as a pivoting portion is capable of supporting an upstream side of the sheet S. A slide member 15 serving as a slide portion, as described later, is supported slidably on the sheet feed tray 11, and the sheet feed tray 11 constitutes an upstream sheet supporting portion 104 with the slide member 15. The upstream sheet supporting portion 104 is arranged upstream of the bottom plate 12 in the sheet feeding direction.

A guide portion 12*a* extending in a sheet width direction orthogonal to the sheet feeding direction is formed on the bottom plate 12, and a pair of side regulating plates 13 and 13 are supported movably in the sheet width direction on the guide portion 12*a*. The side regulating plates 13 and 13 regulate the position of the edge portions in the sheet width direction of the sheet S supported on the bottom plate 12. Further, a leading edge regulating surface 12*b* configured to regulate a leading edge of the sheet S, that is, a downstream end position in the sheet feeding direction, is formed on the bottom plate 12.

The sheet feed tray 11 is configured pivotably between an opened position (refer to FIG. 1) serving as a first position and a closed position (refer to FIG. 16) serving as a second position, about a pivot shaft 11*g* serving as a fulcrum, and in a state where the tray is positioned at the closed position, the tray functions as a side wall of the printer body 101. A trailing edge regulation member 14 is supported movably in the sheet feeding direction by the slide member 15 on the sheet feed tray 11, as described later.

In order to form an image on a sheet S, a user pivots the sheet feed tray 11 from the closed position to the opened position, and opens a sheet storage space 103 within the printer body 101 in which sheets are stored. Then, the user inserts a sheet S in the sheet storage space 103 and places the sheet S on the bottom plate 12 and the sheet feed tray 11, such that the position of the sheet S is regulated by the side regulating plates 13 and 13, the leading edge regulating surface 12*b* and the trailing edge regulation member 14. Thereby, the sheet S will not be deviated when being fed by the feed roller 20, and stable sheet feed can be performed without causing skew feed or jamming of the sheet.

(Configuration Regarding Operation of Trailing Edge Regulating Member)

Figure 3A:
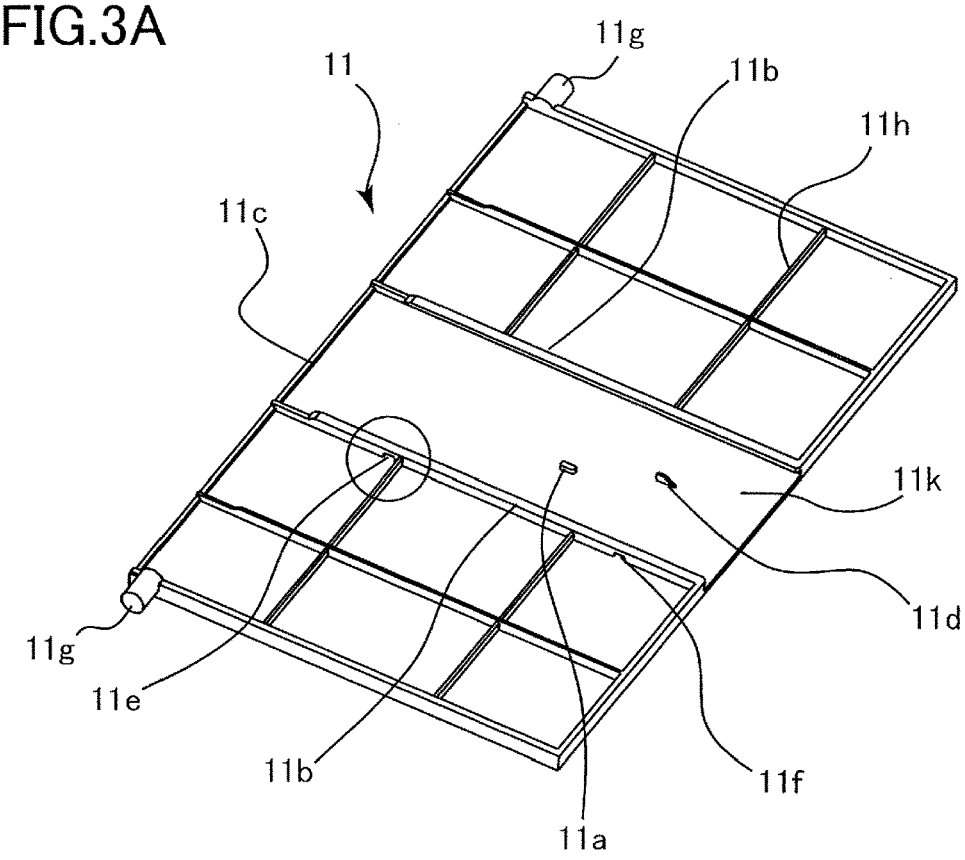
FIG. 3A is a perspective view illustrating a sheet feed tray.

Next, a configuration related to the operation of the trailing edge regulation member 14 serving as the second regulating portion will be described in detail. The sheet feed tray 11 includes, as illustrated in FIG. 3A, a pair of guide portions 11*b* and 11*b* configured to support the slide member 15 slidably, and an abutment surface 11*c* serving as a first regulating portion against which a downstream end 15*c* (refer to FIG. 4A) in the sheet feeding direction of the slide member 15 abuts. Lattice-shaped ribs 11*h* are formed in areas of the sheet feed tray 11 other than a smooth surface 11*k* serving as a movement locus of the slide member 15, such that a frictional force to the sheet S is reduced and stiffness of the sheet feed tray 11 is improved.

Figure 3B:
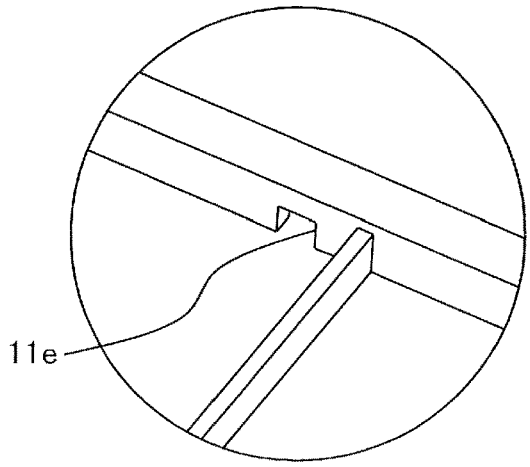
FIG. 3B is an enlarged view illustrating a hole formed on the guide portion.

Ribs 11*a* and 11*d* projecting upward in a state in which the sheet feed tray 11 is positioned at a closed position are formed on the smooth surface 11*k* of the sheet feed tray 11. Holes 11*e* and 11*f* are respectively formed at symmetric positions in the sheet width direction on the pair of guide portions 11*b* and 11*b*, as illustrated in FIGS. 3A and 3B.

Figure 4A:
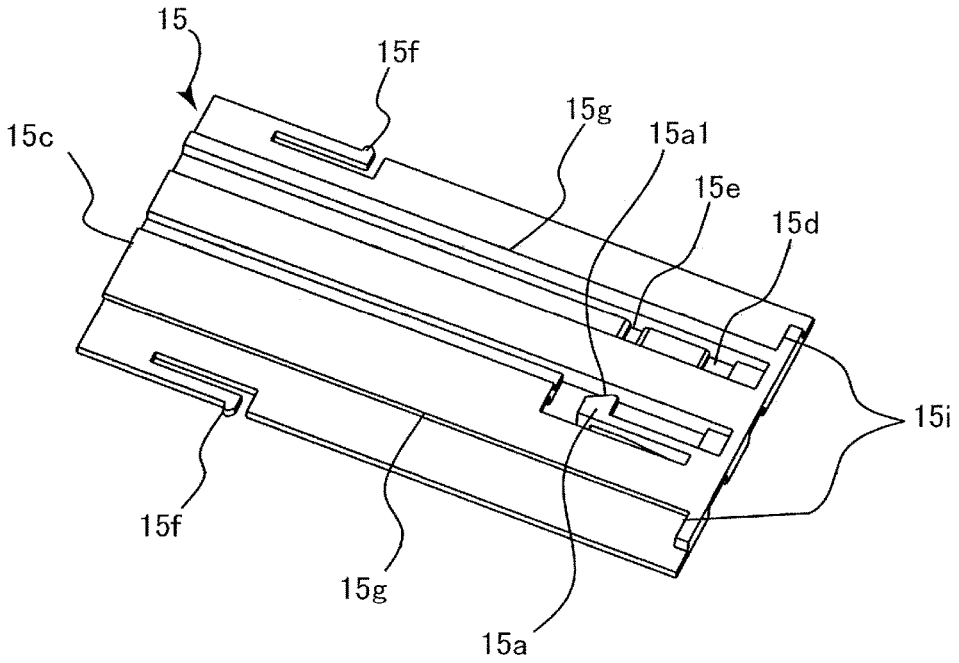
FIG. 4A is an upper perspective view illustrating a slide member.
Figure 4B:
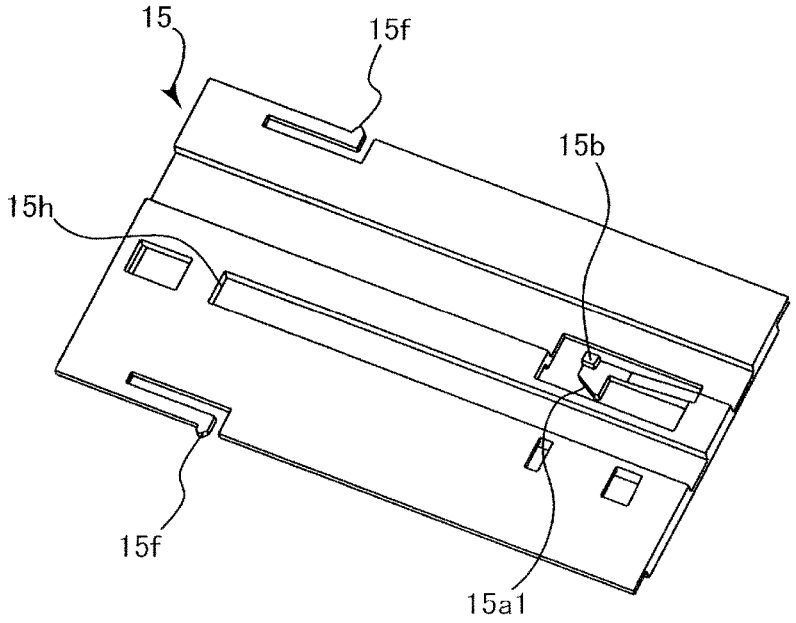
FIG. 4B is a bottom perspective view illustrating the slide member.

As illustrated in FIGS. 4A and 4B, a downstream end 15*c* configured to abut against the abutment surface 11*c* of the sheet feed tray 11, hooks 15*f* and 15*f* configured to engage with the holes 11*e* and 11*f* of the sheet feed tray 11, and guide portions 15*g* an 15*g* serving as a pair of second guides are formed on the slide member 15. The hook 15*f* has an elongated shape, and is configured to be able to deform elastically in the sheet width direction.

Further, holes 15*d* and 15*e*, abutment surfaces 15*h* and 15*i*, and a claw portion 15*a* are formed on the slide member 15. The abutment surface 15*h* is provided on a bottom surface of the slide member 15, and is configured to engage with a rib 11*d* serving as a first stopper on the sheet feed tray 11. The claw portion 15*a* serving as an engagement portion and an elastic member is formed in an elongated shape, configured to elastically deform in the sheet width direction, and includes an inclined surface 15*a*1 and a projecting portion 15*b* projecting downward.

Figure 5A:
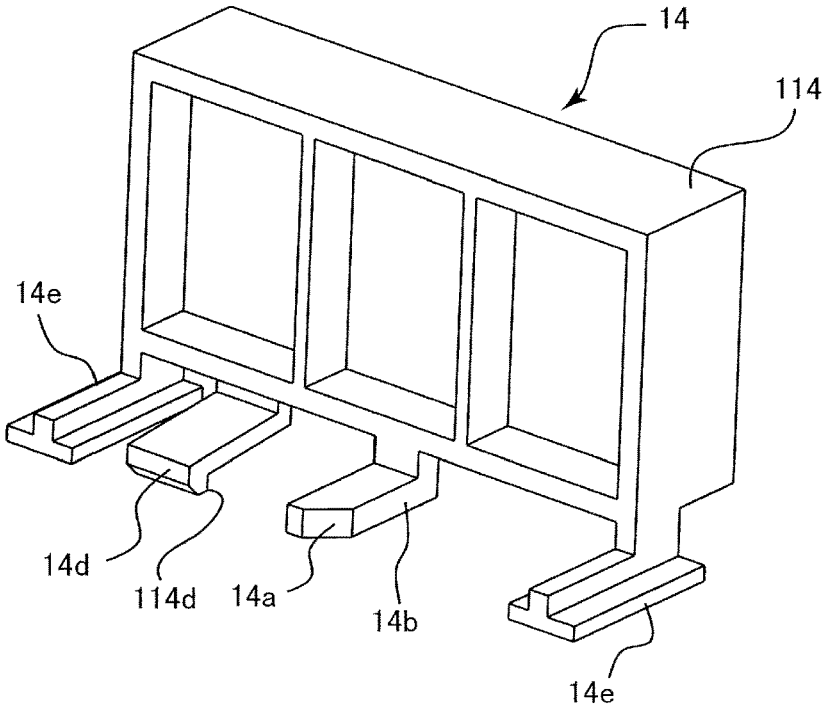
FIG. 5A is a front perspective view illustrating a trailing edge regulation member.
Figure 5B:
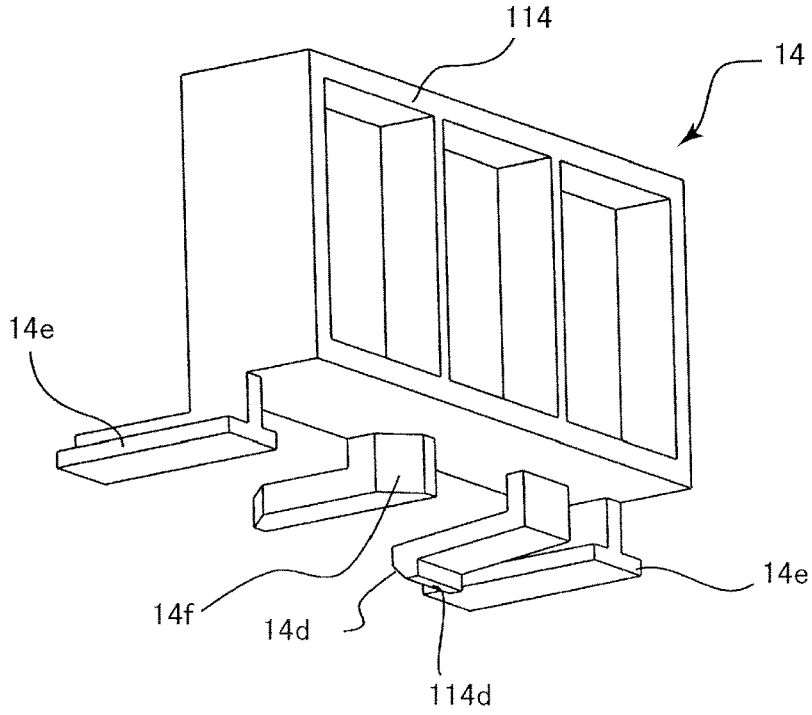
FIG. 5B is a rear perspective view illustrating the trailing edge regulation member.

The trailing edge regulation member 14 includes, as illustrated in FIGS. 5A and 5B, a knob portion 114 to be held by the user, and engagement portions 14*e* and 14*e*. The trailing edge regulation member 14 is supported movably in the sheet feeding direction with respect to the slide member 15 by the engagement portions 14*e* and 14*e* being engaged with the pair of guide portions 15*g* and 15*g* on the slide member 15. The guide portions 15*g* and 15*g* are formed to project in the sheet feeding direction so as to partially interfere with an upper portion of the engagement portions 14*e* and 14*e*, and the trailing edge regulation member 14 is retained from being disengaged upward from the slide member 15. As illustrated in FIG. 1, the bottom plate 12 has a rectangular cutout 12*f* at an upstream side in the sheet feeding direction, and the cutout 12*f* includes an abutment surface 12*d*, and guide portions 12*e* and 12*e* serving as a pair of first guides. The engagement portions 14*e* and 14*e* of the trailing edge regulation member 14 engages with the guide portions 12*e* and 12*e* of the bottom plate 12, and is guided movably in the sheet feeding direction.

The trailing edge regulation member 14 has, as illustrated in FIGS. 5A and 5B, a rib 14*b* extending downstream in the sheet feeding direction from a lower edge portion, and a claw portion 14*d*. Inclined surfaces 14*a* and 14*f* inclined in the sheet width direction are formed at a tip and a base of the rib 14*b*, and an engagement claw 114*d* serving as a projecting portion projecting downward toward the slide member 15 is formed at a tip of the claw portion 14*d*.

(Operation of Trailing Edge Regulating Member)

Next, an operation of the trailing edge regulation member 14 will be described in detail. In the following description, only one of a pair of guide portions 11*b*, 12*e* and 15*g*, holes 11*e* and 11*f*, engagement portions 14*e* and hooks 15*f* will be described, and the other one will not be described.

Figure 6A:
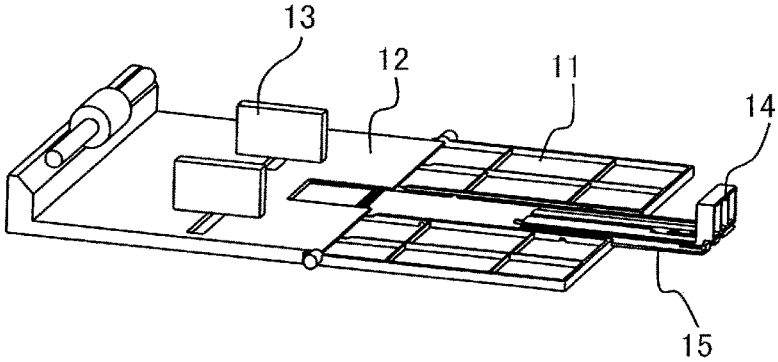
FIG. 6A is a perspective view illustrating the trailing edge regulation member positioned at a first position.
Figure 6B:
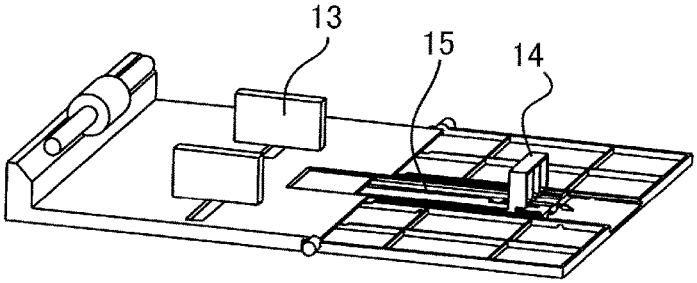
FIG. 6B is a perspective view illustrating the trailing edge regulation member positioned at a second position.
Figure 6C:
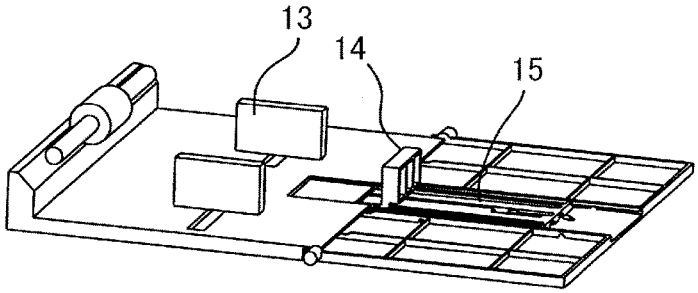
FIG. 6C is a perspective view illustrating the trailing edge regulation member positioned at a third position.
Figure 6D:
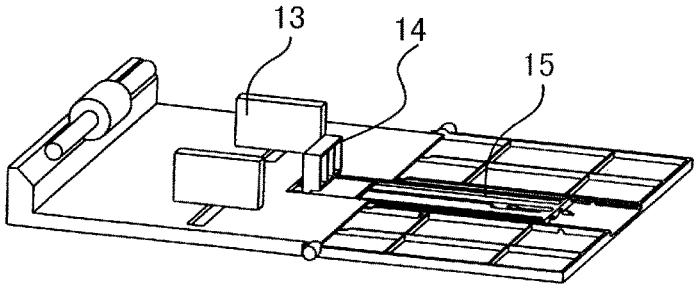
FIG. 6D is a perspective view illustrating the trailing edge regulation member positioned at a fourth position.

The trailing edge regulation member 14 operates, as illustrated in FIGS. 6A through 6D, to regulate a trailing edge of sheets of various sizes having different lengths in the sheet feeding direction, that is, an upstream end position in the sheet feeding direction. Here, a sheet corresponding to the position of the trailing edge regulation member 14 illustrated in FIG. 6A is referred to as a first sized sheet, and a sheet corresponding to the position of the trailing edge regulation member 14 illustrated in FIG. 6B is referred to as a second sized sheet. A sheet corresponding to the position of the trailing edge regulation member 14 illustrated in FIG. 6C is referred to as a third sized sheet, and a sheet corresponding to the position of the trailing edge regulation member 14 illustrated in FIG. 6D is referred to as a fourth sized sheet. The first sized sheet is a sheet of a maximum size capable of being fed in the sheet feeding apparatus 102, and the fourth sized sheet is a sheet of a minimum size capable of being fed in the sheet feeding apparatus 102.

A position of the trailing edge regulation member 14 regulating the trailing edge of the first sized sheet is referred to as a first position, and a position of the trailing edge regulation member 14 regulating the trailing edge of the second sized sheet is referred to as a second position. A position of the trailing edge regulation member 14 regulating the trailing edge of the third sized sheet is referred to as a third position, and a position of the trailing edge regulation member 14 regulating the trailing edge of the fourth sized sheet is referred to as a fourth position.

Figure 7A:
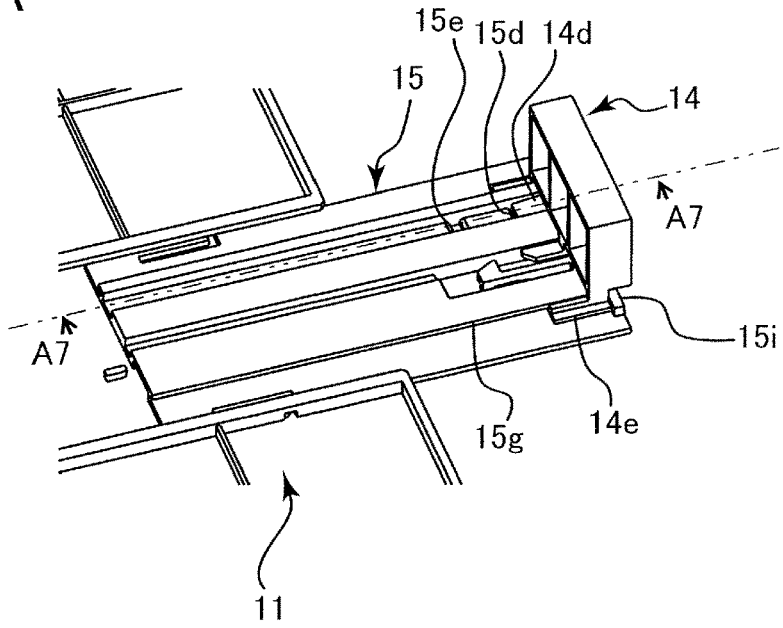
FIG. 7A is a perspective view illustrating the trailing edge regulation member positioned at the first position.
Figure 7B:
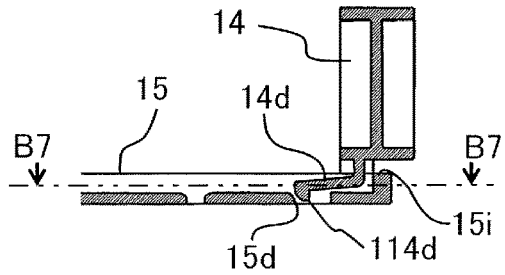
FIG. 7B is a cross-sectional view of cross-section A7-A7 illustrating the trailing edge regulation member positioned at the first position.

At first, an operation for moving the trailing edge regulation member 14 from the first position to the fourth position will be described. In a state where the trailing edge regulation member 14 is positioned at the first position, as illustrated in FIGS. 7A and 7B, a trailing edge of an engagement portion 14*e* is abutted against an abutment surface 15*i* of the slide member 15, and movement upstream in the sheet feeding direction is regulated. The engagement claw 114*d* of the trailing edge regulation member 14 is engaged to a hole 15*d* of the slide member 15 with a slight gap, and the trailing edge regulation member 14 is regulated from moving with respect to the slide member 15 with a backlash.

Figure 7C:
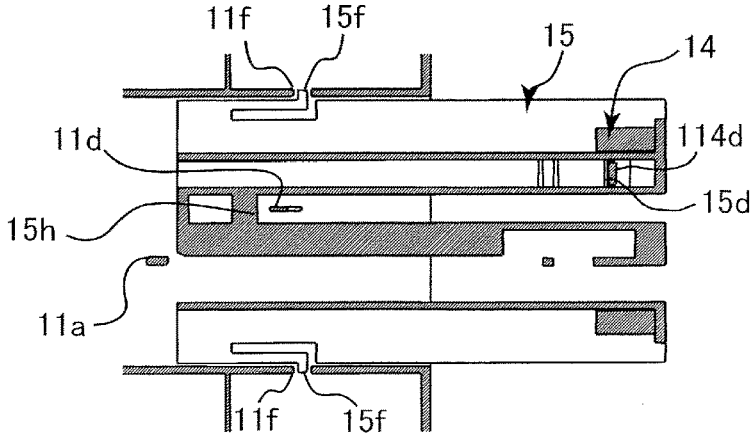
FIG. 7C is a cross-sectional view of cross-section B7-B7 illustrating the trailing edge regulation member positioned at the first position.

The hook 15*f* of the slide member 15 is engaged with a hole 11*f* on the sheet feed tray 11, as illustrated in FIG. 7C, and the abutment surface 15*h* is engaged with the rib 11*d* of the sheet feed tray 11 with a gap of a few mm. Thus, even if the slide member 15 moves further upstream in the sheet feeding direction from the position illustrated in FIG. 7C, the abutment surface 15*h* of the slide member 15 abuts against the rib 11*d*, and the slide member 15 is prevented from being disengaged from the sheet feed tray 11. That is, the rib 11*d* positions the slide member 15 at the first slide position upstream in the sheet feeding direction. As described, the slide member 15 is regulated from moving with respect to the sheet feed tray 11 with a backlash.

Figure 8A:
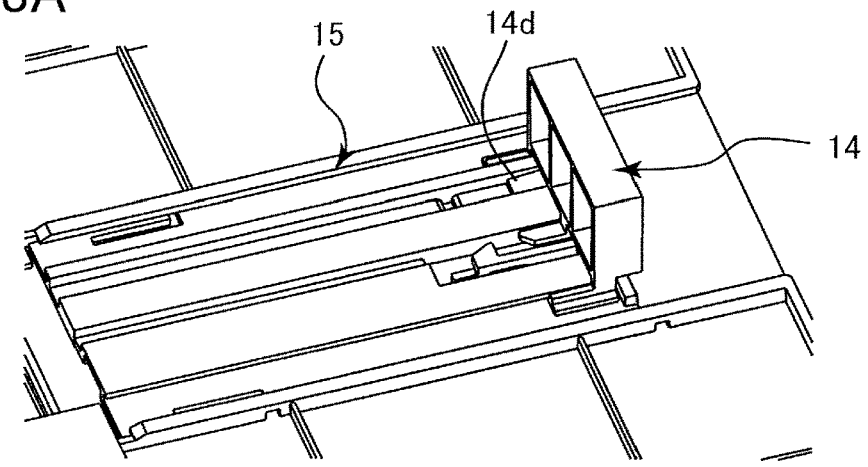
FIG. 8A is a perspective view illustrating a state in which a claw portion of the slide member is abutted against a rib of a sheet feed tray.
Figure 8B:
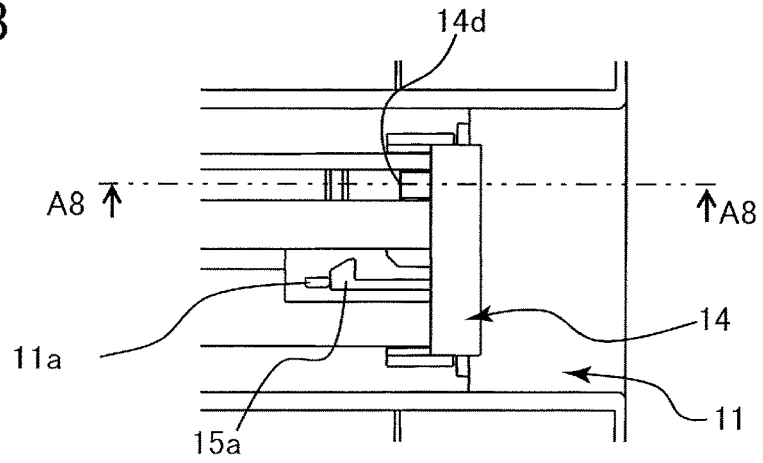
FIG. 8B is a plan view illustrating a state in which the claw portion of the slide member is abutted against the rib of the sheet feed tray.
Figure 8C:
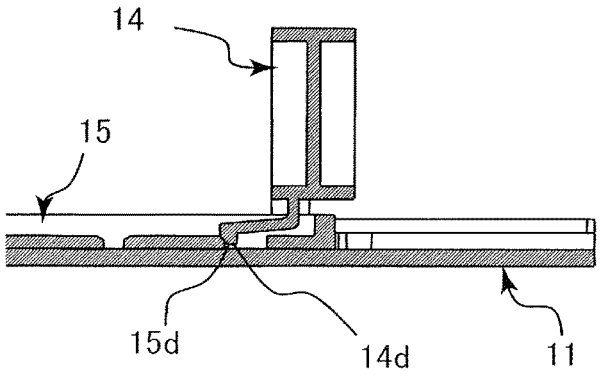
FIG. 8C is a cross-sectional view of cross-section A8-A8 illustrating the state in which the claw portion of slide member is abutted against the rib of the sheet feed tray.

If the user attempts to move the trailing edge regulation member 14 from the first position to the second position, as illustrated in FIG. 8C, the claw portion 14*d* abuts against the hole 15*d* of the slide member 15, the trailing edge regulation member 14 is integrated with the slide member 15 and moves downstream in the sheet feeding direction. Then, the hook 15*f* of the slide member 15 is deformed elastically and is disengaged from the hole 11*f* on the sheet feed tray 11, and as illustrated in FIGS. 8A and 8B, the claw portion 15*a* of the slide member 15 is abutted against a rib 11*a* serving as a second stopper on the sheet feed tray 11. That is, the rib 11*a* positions the slide member 15 at the second slide position downstream in the sheet feeding direction.

Then, the hook 15*f* of the slide member 15 is engaged with a hole 11*e* serving as a positioning portion on the sheet feed tray 11. For example, the trailing edge regulation member 14 regulates a trailing edge position of an A4 sized sheet at this position, a legal sized sheet at the first position, a letter sized sheet at the second position, and a postcard sized sheet or an irregular sized sheet at the fourth position.

Figure 9A:
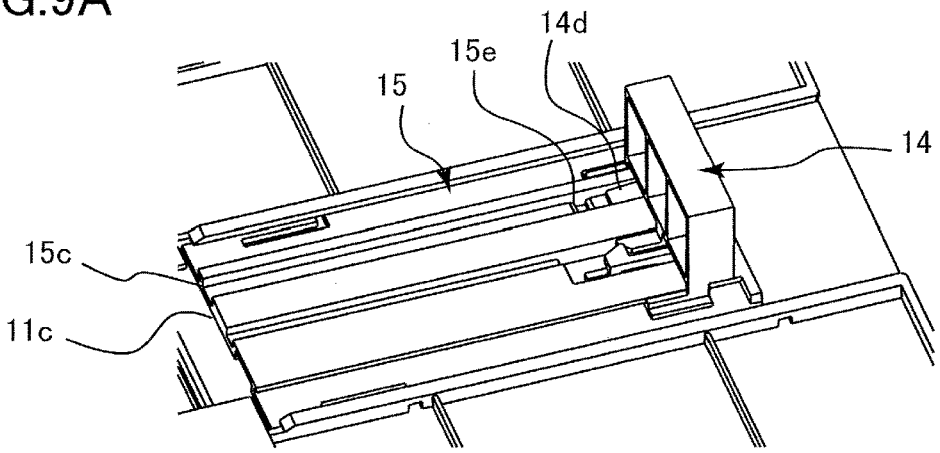
FIG. 9A is a perspective view illustrating a state in which an inclined surface of the trailing edge regulation member is abutted against the claw portion of the slide member.
Figure 9B:
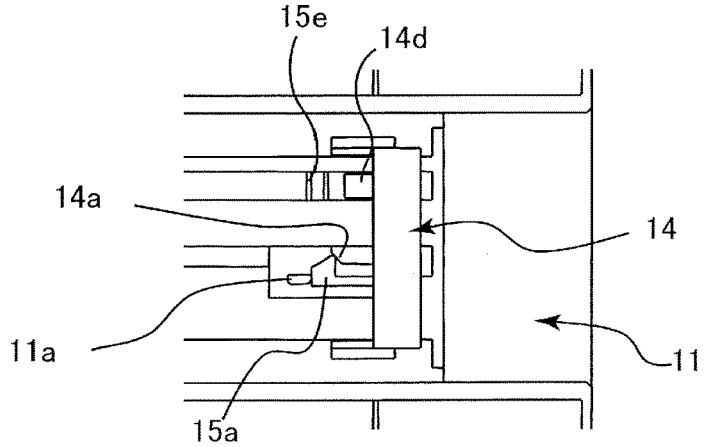
FIG. 9B is a plan view illustrating a state in which the inclined surface of the trailing edge regulation member is abutted against the claw portion of the slide member.
Figure 9C:
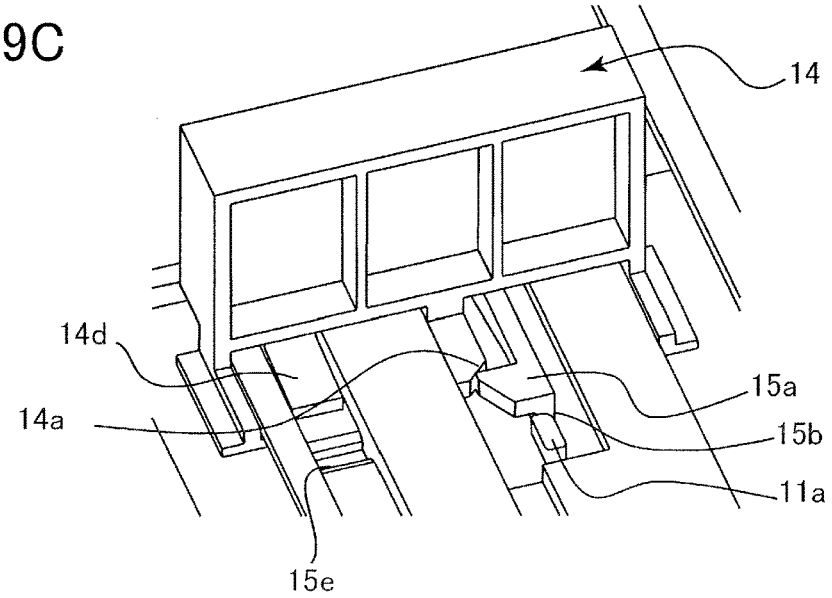
FIG. 9C is a perspective view taken from a front side of a state in which the inclined surface of the trailing edge regulation member is abutted against the claw portion of the slide member.

If the user moves the trailing edge regulation member 14 downstream in the sheet feeding direction from the position illustrated in FIG. 8A, the claw portion 14*d* of the trailing edge regulation member 14 is removed from the hole 15*d* of the slide member 15, as illustrated in FIGS. 9A through 9C. Then, the trailing edge regulation member 14 moves downstream in the sheet feeding direction for a predetermined distance, and an inclined surface 14*a* serving as a release portion of the trailing edge regulation member 14 is abutted against the claw portion 15*a* of the slide member 15.

Figure 10A:
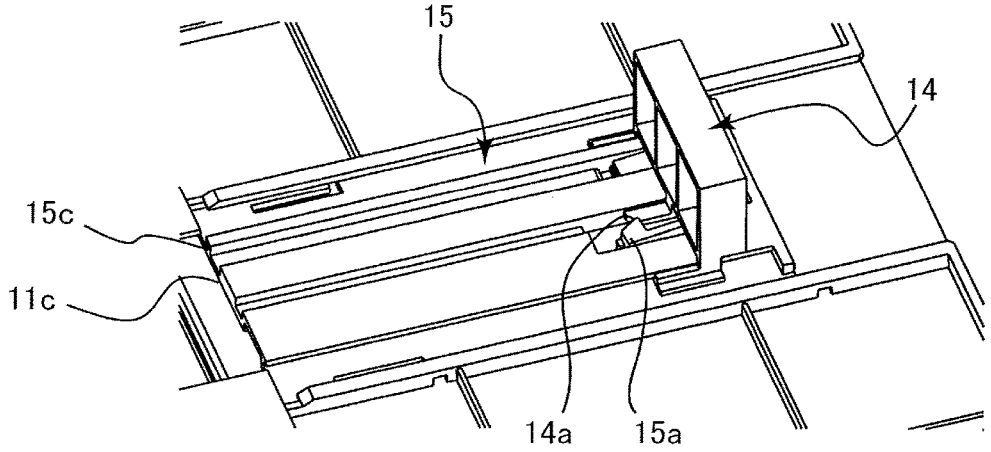
FIG. 10A is a perspective view illustrating a state in which the trailing edge regulation member is positioned at a second position.
Figure 10B:
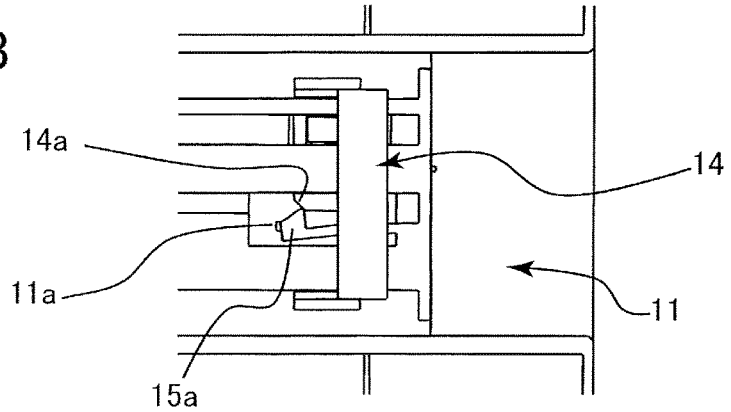
FIG. 10B is a plan view illustrating a state in which the trailing edge regulation member is positioned at the second position.
Figure 10C:
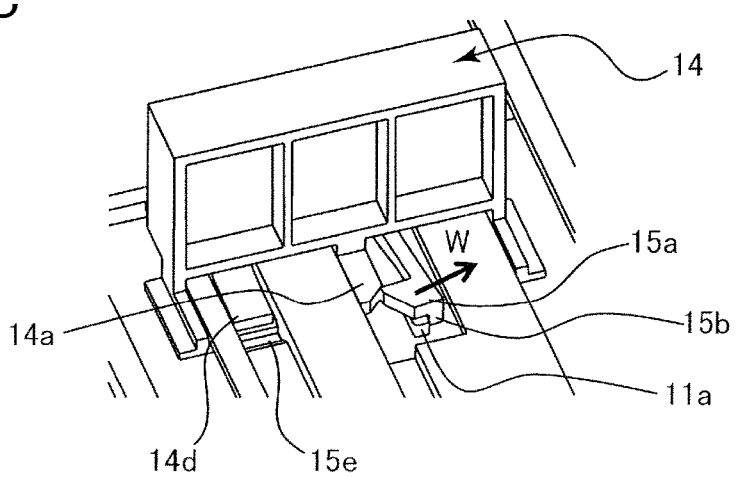
FIG. 10C is a perspective view taken from a front side illustrating a state in which the trailing edge regulation member is positioned at the second position.

In this state, if the user moves the trailing edge regulation member 14 further downstream in the sheet feeding direction, as illustrated in FIGS. 10A through 10C, the inclined surface 14*a* is pressed by the claw portion 15*a*, and the claw portion 15*a* moves in the direction of arrow W intersecting with the sheet feeding direction. Thus, the projecting portion 15*b* of the claw portion 15*a* escapes from the rib 11*a*, and the trailing edge regulation member 14 is enabled to move downstream in the sheet feeding direction. Then, the claw portion 14*d* (or the engagement claw 114*d*) of the trailing edge regulation member 14 engages with a hole 15*e* serving as an engaged portion of the slide member 15 with a slight gap. Thereby, the trailing edge regulation member 14 is regulated from moving with respect to the slide member 15, and the claw portion 15*a* of the slide member 15 is retained in a pressed state by the inclined surface 14*a* of the trailing edge regulation member 14.

In this state, if the user moves the trailing edge regulation member 14 downstream in the sheet feeding direction, the trailing edge regulation member 14 and the slide member 15 move integrally, and the hook 15*f* of the slide member 15 is separated from the hole 11*e* of the sheet feed tray 11. Then, the downstream end 15*c* of the slide member 15 abuts against the abutment surface 11*c* of the sheet feed tray 11. Thereby, the slide member 15 is regulated from moving downstream in the sheet feeding direction with respect to the sheet feed tray 11. At this time, the trailing edge regulation member 14 is positioned at the second position. According to the present embodiment, the abutment surface 11*c* is formed at the downstream end in the sheet feeding direction of the sheet feed tray 11, but the arrangement is not restricted to this example. In other words, the abutment surface 11*c* can be arranged anywhere on the sheet feed tray 11, as long as the abutment surface 11*c* abuts against the slide member 15 such that the downstream end 15*c* of the slide member 15 does not move above the bottom plate 12. That is, the downstream end 15*c* of the slide member 15 does not overlap with the bottom plate 12 in a vertical direction.

A frictional force between the claw portion 14*d* of the trailing edge regulation member 14 and the holes 15*d* and 15*e* of the slide member 15 is designed to be greater than a frictional force between the hook 15*f* of the slide member 15 and the holes 11*e* and 11*f* of the sheet feed tray 11.

Figure 11A:
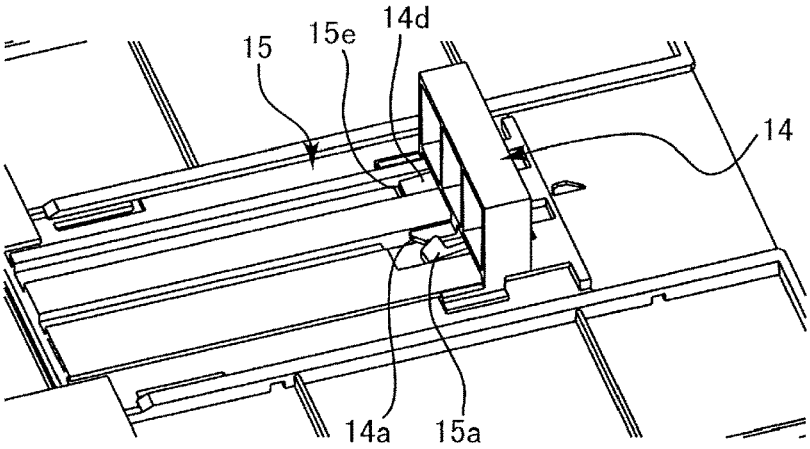
FIG. 11A is a perspective view illustrating a state in which the claw portion of the trailing edge regulation member is abutted against a leading edge of the hole on the slide member.
Figure 11B:
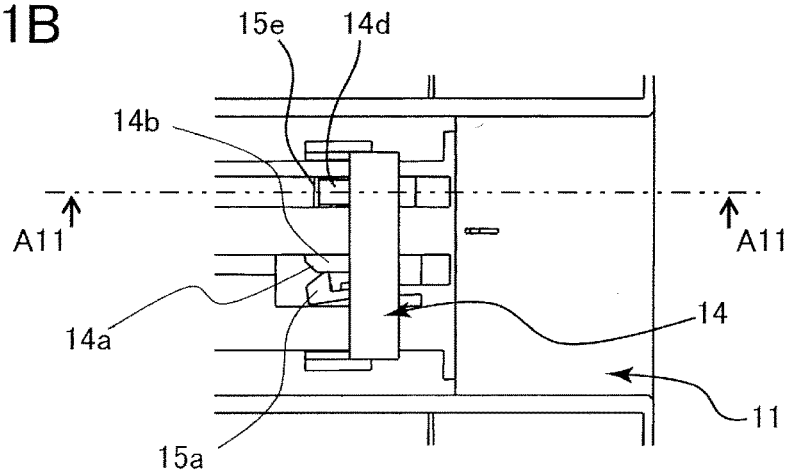
FIG. 11B is a plan view illustrating a state in which the claw portion of the trailing edge regulation member is abutted against the leading edge of the hole on the slide member.
Figure 11C:
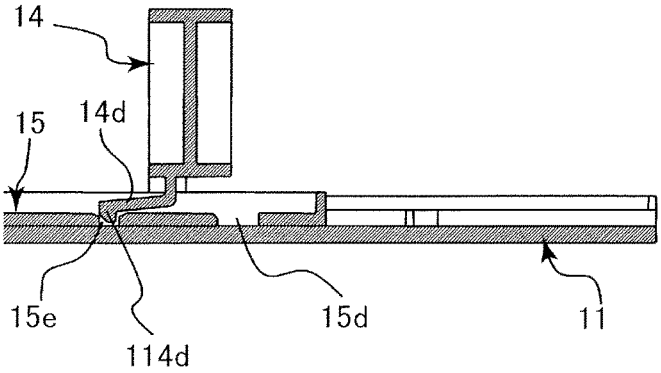
FIG. 11C is a cross-sectional view of cross-section A11-A11 illustrating a state in which the claw portion of the trailing edge regulation member is abutted against the leading edge of the hole on the slide member.
Figure 12A:
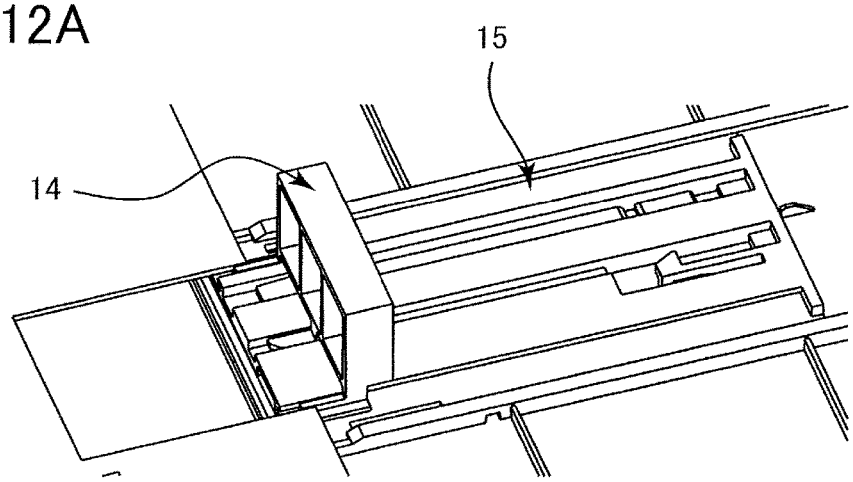
FIG. 12A is a perspective view illustrating a state in which the trailing edge regulation member is positioned at a third position.

If the user attempts to move the trailing edge regulation member 14 from the second position further downstream in the sheet feeding direction, as illustrated in FIGS. 11A through 11C, the inclined surface 14*a* and the rib 14*b* push in the claw portion 15*a* of the slide member 15, while only the trailing edge regulation member 14 moves. Then, the trailing edge regulation member 14 moves to the downstream end in the slide direction of the slide member 15, as illustrated in FIG. 12A, and at this time, the trailing edge regulation member 14 is positioned at the third position. It is also possible to form a hole to which the claw portion 14*d* can engage on the slide member 15 in a state where the trailing edge regulation member 14 is positioned at the third position.

Figure 12B:
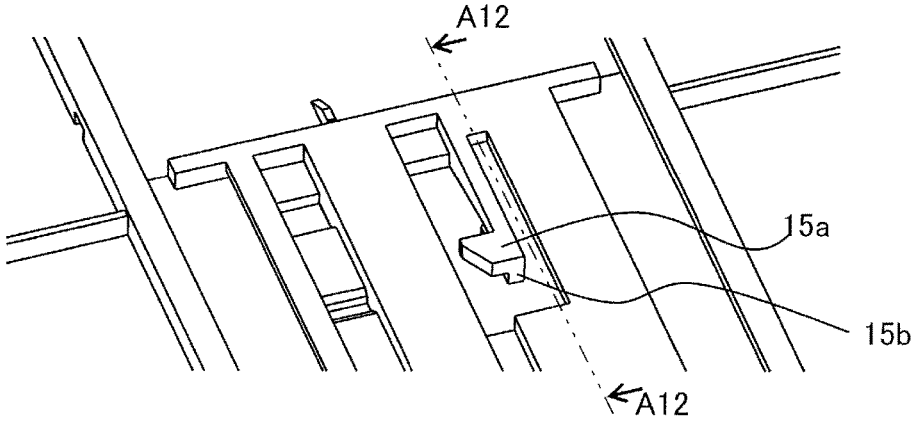
FIG. 12B is a perspective view taken from an upper side of a state in which the trailing edge regulation member is positioned at the third position.
Figure 12C:
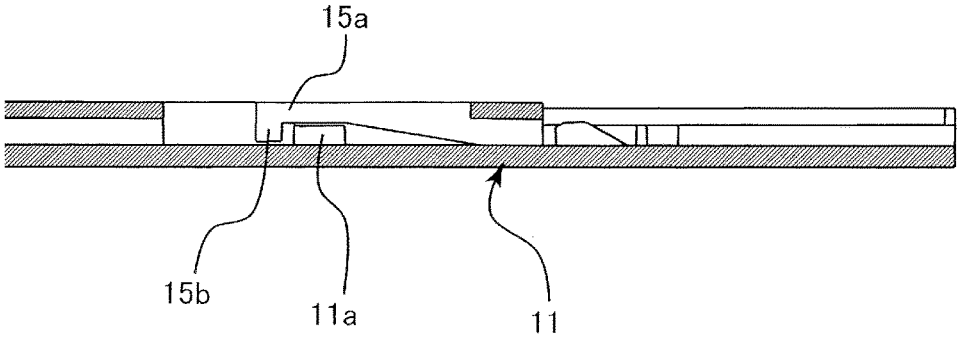
FIG. 12C is a cross-sectional view of cross-section A12-A12 illustrating a state in which the trailing edge regulation member is positioned at the third position.

In a state where the trailing edge regulation member 14 is positioned at the third position, the rib 14*b* of the trailing edge regulation member 14 is separated from the claw portion 15*a* of the slide member 15, and the claw portion 15*a* is returned to a free state. At this time, as illustrated in FIGS. 12B and 12C, the rib 11*a* of the sheet feed tray 11 is sandwiched by the projecting portion 15*b* and a base edge portion of the claw portion 15*a* in the sheet feeding direction. Therefore, the slide member 15 is regulated from moving with respect to the sheet feed tray 11 with a backlash.

If the user attempts to move the trailing edge regulation member 14 from the third position further downstream in the sheet feeding direction, as illustrated in FIG. 13, the engagement portion 14*e* of the trailing edge regulation member 14 is handed over from a guide portion 15*g* of the slide member 15 to a guide portion 12*e* of the bottom plate 12. That is, the guide portions 12*e* and 15*g* constitute a continuous guide portion 30 serving as a guide portion formed continuously across the bottom plate 12 and the upstream sheet supporting portion 104. The continuous guide portion 30 guides the trailing edge regulation member 14 movably in the sheet feeding direction between the bottom plate 12 and the upstream sheet supporting portion 104. Then, the continuous guide portion 30 regulates movement of the trailing edge regulation member 14 in the sheet width direction.

Figure 13A:
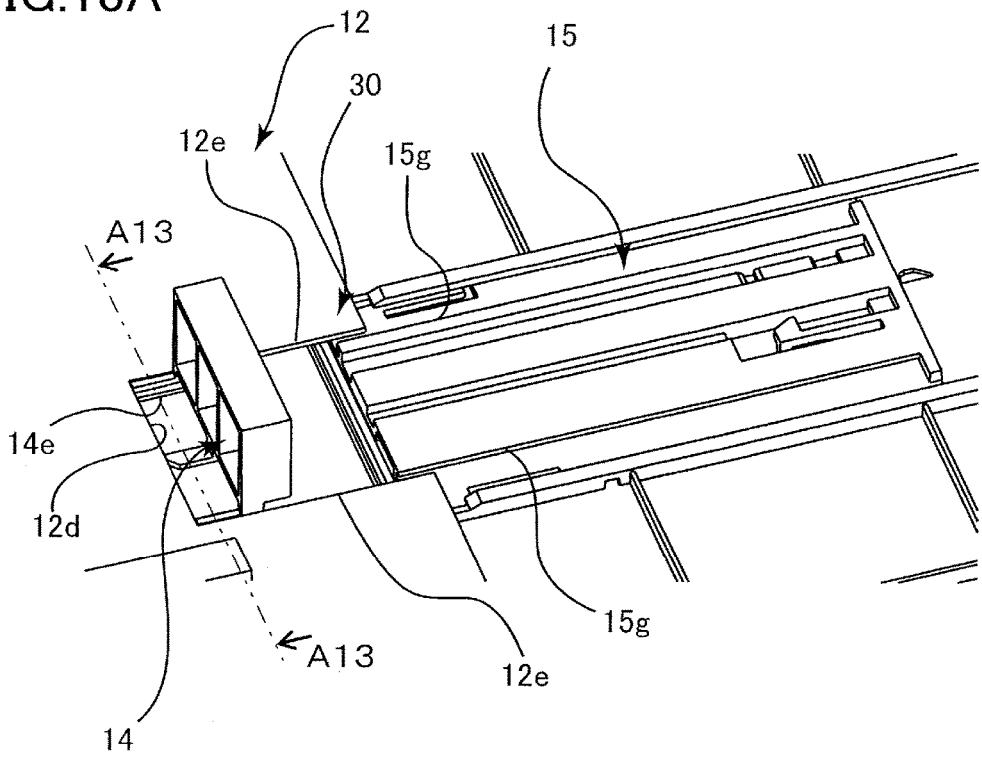
FIG. 13A is a perspective view illustrating a state in which the trailing edge regulation member is positioned at a fourth position.
Figure 13B:
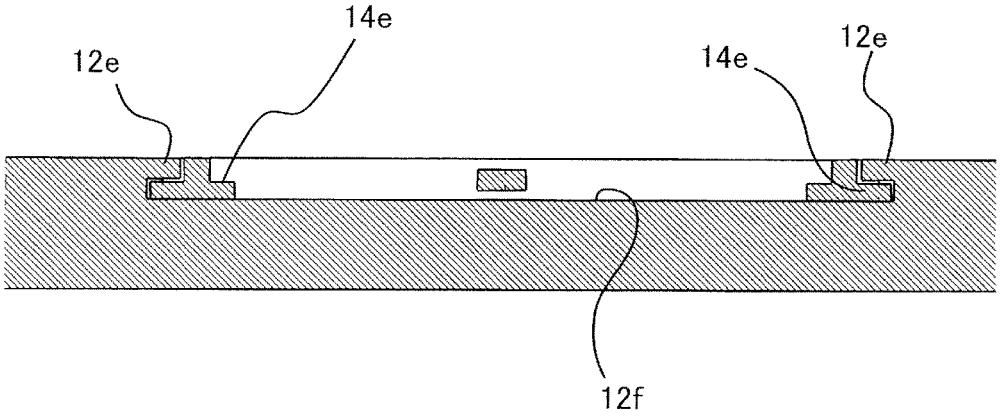
FIG. 13B is a cross-sectional view of cross-section A13-A13 illustrating a state in which the trailing edge regulation member is positioned at a fourth position.

In a state where the trailing edge regulation member 14 is guided by the guide portion 12*e* of the bottom plate 12 and moves downstream in the sheet feeding direction, as illustrated in FIGS. 13A and 13B, a leading end of the engagement portion 14*e* of the trailing edge regulation member 14 abuts against the abutment surface 12*d* of the bottom plate 12. At this time, the trailing edge regulation member 14 is positioned at a fourth position regulating the trailing edge of a sheet having the minimum size that can be fed by the sheet feeding apparatus 102. Further, since the slide member 15 is regulated from moving with respect to the sheet feed tray 11, as described earlier, the user cannot move the slide member 15.

Next, an operation for moving the trailing edge regulation member 14 from the fourth position to the first position will be described. The basic operation of the trailing edge regulation member 14 is similar to the operation described with reference to FIGS. 6A through 13B, but the operation in which the claw portion 15*a* of the slide member is removed from the rib 11*a* of the sheet feed tray 11 differs from the operation described above. Therefore, the operation in which the claw portion 15*a* of the slide member 15 is removed from the rib 11*a* of the sheet feed tray 11 will mainly be described, and similar descriptions as those described earlier are omitted.

In a state where the user attempts to move the trailing edge regulation member 14 from the fourth position to the third position, and further to the second position, an inclined surface 14*f* formed on the rib 14*b* of the trailing edge regulation member 14 is abutted against the claw portion 15*a* of the slide member 15. In this state, if the trailing edge regulation member 14 is moved upstream in the sheet feeding direction, as illustrated in FIG. 11C, the engagement claw 114*d* of the trailing edge regulation member 14 is engaged with the hole 15*e* of the slide member 15 in a state where the rib 14*b* has deformed the claw portion 15*a* in the sheet width direction.

Figure 14A:
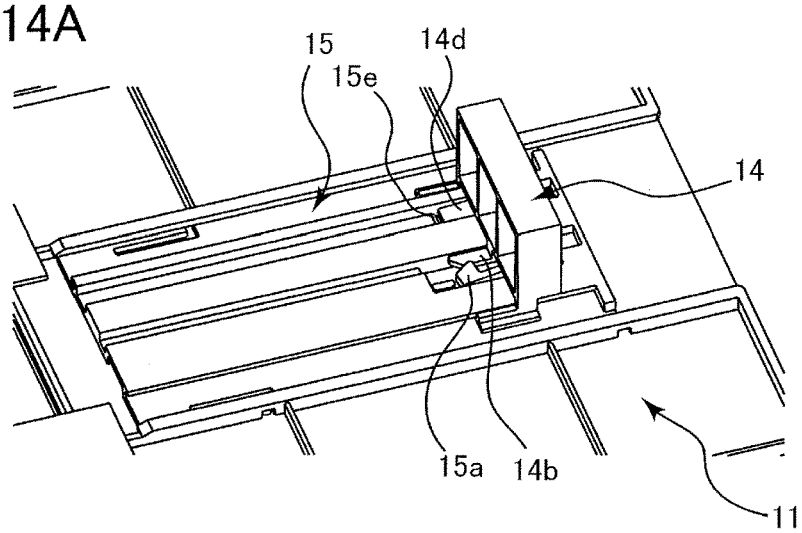
FIG. 14A is a perspective view illustrating a state in which an engagement between the claw portion of the slide member and a rib on a sheet feed tray are released.
Figure 14B:
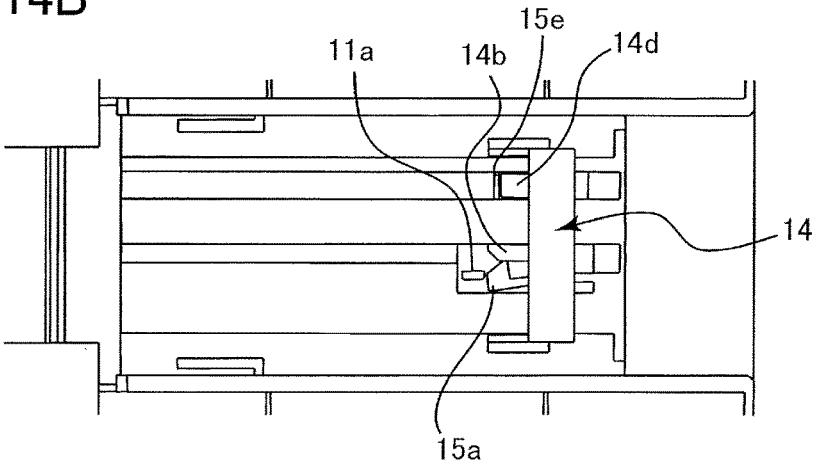
FIG. 14B is a plan view illustrating a state in which the engagement between the claw portion of the slide member and the rib on the sheet feed tray are released.
Figure 14C:
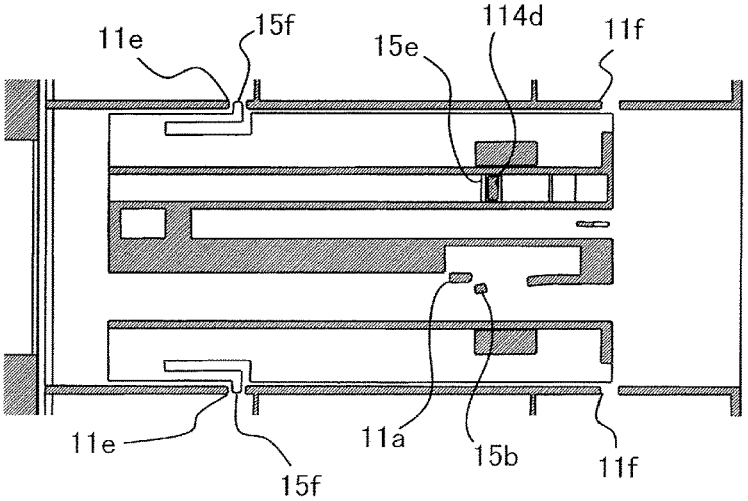
FIG. 14C is a cross-sectional view illustrating a state in which the engagement between the claw portion of the slide member and the rib on the sheet feed tray are released.

If the trailing edge regulation member 14 is moved further upstream in the sheet feeding direction, the engagement claw 114*d* of the trailing edge regulation member 14 abuts against an edge portion of the hole 15*e*, and the trailing edge regulation member 14 moves integrally with the slide member 15. As illustrated in FIGS. 14A through 14C, if the projecting portion 15*b* formed on the claw portion 15*a* of the slide member 15 moves past the rib 11*a*, the hook 15*f* of the slide member 15 engages with the hole 11*e* of the sheet feed tray 11.

Figure 15:
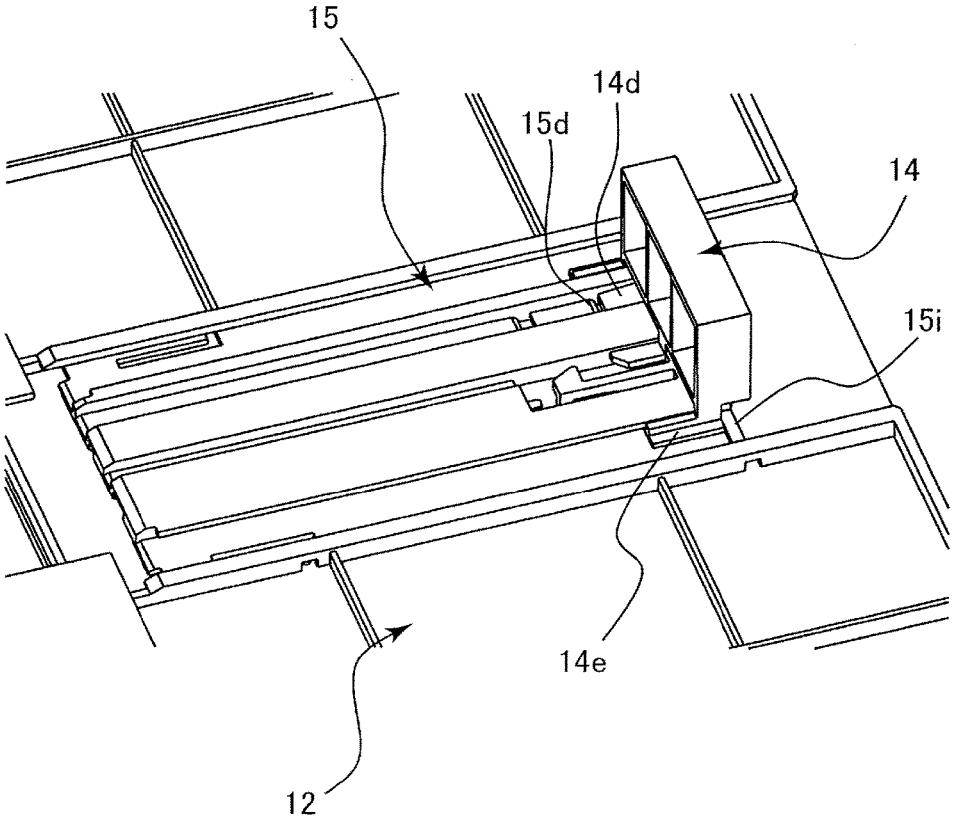
FIG. 15 is a perspective view illustrating a state in which the trailing edge regulation member is positioned at a first position.

If the user moves the trailing edge regulation member further upstream in the sheet feeding direction, the engagement claw 114*d* of the trailing edge regulation member 14 is removed from the hole 15*e*, and only the trailing edge regulation member 14 is moved upstream in the sheet conveyance direction. Then, as illustrated in FIG. 15, the trailing edge of the engagement portion 14*e* of the trailing edge regulation member 14 is abutted against the abutment surface 15*i* of the slide member 15, and the claw portion 14*d* is engaged with the hole 15*d*.

If the user moves the trailing edge regulation member further upstream in the sheet feeding direction, the trailing edge regulation member 14 moves integrally with the slide member 15, and the hook 15*f* of the slide member 15 is disengaged with the hole 11*e* of the sheet feed tray 11. Then, the hook 15*f* of the slide member 15 engages with the hole 11*f* of the sheet feed tray 11, as illustrated in FIG. 7C, and the trailing edge regulation member 14 is positioned at the first position. As described earlier, if the trailing edge regulation member 14 is moved further upstream in the sheet feeding direction, the abutment surface 15*h* of the slide member 15 is abutted against the rib 11*d* of the sheet feed tray 11, and the slide member 15 is regulated from moving with respect to the sheet feed tray 11.

As described above, the trailing edge regulation member 14 is capable of moving from the first position positioned upstream in the sheet feeding direction from the trailing edge of the sheet feed tray 11 to the fourth position positioned downstream in the sheet feeding direction than a leading edge of the sheet feed tray 11. Thus, the trailing edge of sheets having various sizes can be regulated certainly by a simple configuration, and stable feeding of sheets can be performed without causing skew feed or jamming of sheets. For example, the position of the upstream end of the sheet can be regulated certainly even in a small sized sheet where the upstream edge of the sheet is not positioned above the sheet feed tray 11. Further, the slide member 15 is moved in an interlocked manner by manipulating the trailing edge regulation member 14 without having to remove the trailing edge regulation member 14 from the sheet feed tray 11, such that the operability can be improved.

Further, the downstream end 15*c* of the slide member 15 and the abutment surface 11*c* of the sheet feed tray 11 are abutted against each other such that the downstream end 15*c* of the slide member 15 is prevented from moving above the bottom plate 12. Thus, the slide member 15 will not be arranged across the bottom plate 12 and the sheet feed tray 11, and damaging of the slide member 15 can be prevented even if the sheet feed tray 1 is pivoted.

Figure 16:
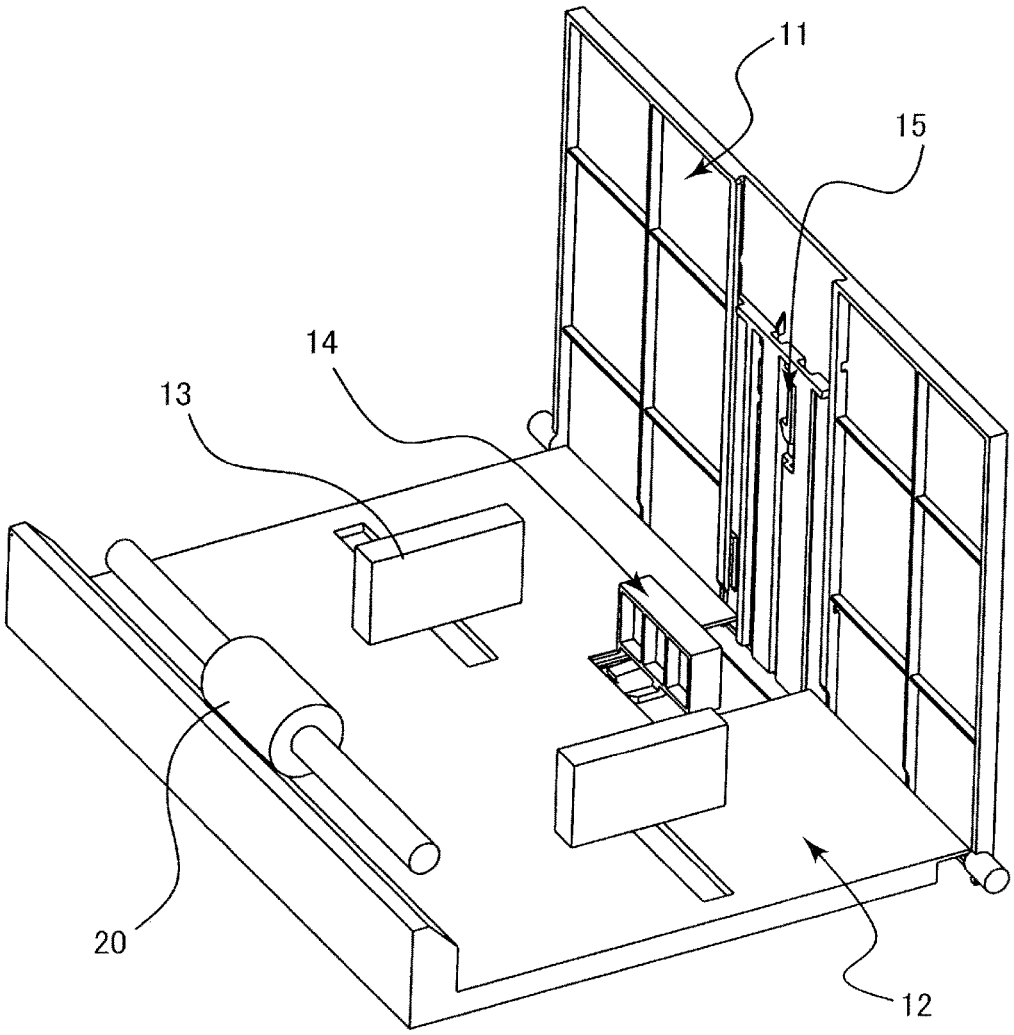
FIG. 16 is a perspective view illustrating a state in which the sheet feed tray is positioned at a closed position.

Further, in a state where a small sized sheet such as a postcard-sized sheet whose trailing edge does not reach the sheet feed tray 11 is fed, as illustrated in FIG. 16, the sheet can be fed in a state where the sheet feed tray 11 is positioned at the closed position. Further, the sheet feed tray 11 is capable of moving to the closed position in a state where all the trailing edge regulation members 14 are supported by the guide portion 12*e* of the bottom plate 12. As described, by using the sheet feeding apparatus 102 in a state where the sheet feed tray 11 is closed to correspond to the sheet size, the operation noise or conveyance noise during conveyance of sheets can be blocked, and noise can be cut down. Further, by using the apparatus with the sheet feed tray 11 closed, the image forming apparatus can be used in a more compact state.

Second Embodiment

Next, a second embodiment of the present invention will be described. The second embodiment adopts a configuration where the claw portion 15*a* formed on the slide member 15 according to the first embodiment is replaced with a lever 26. Therefore, configurations similar to the first embodiment are either not shown in the drawing, or denoted with the same reference numbers.

Figure 17A:
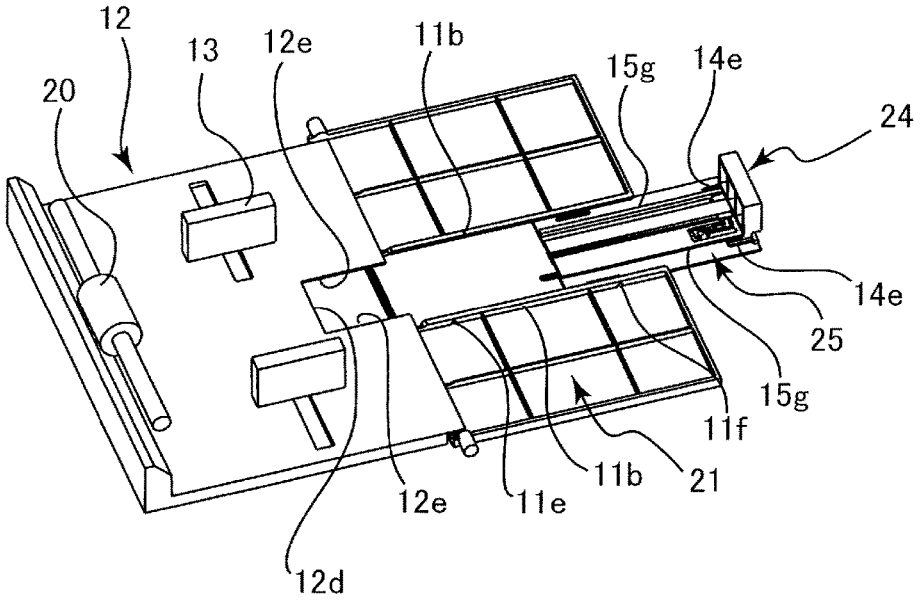
FIG. 17A is a perspective view illustrating a sheet feeding apparatus according to a second embodiment.
Figure 17B:
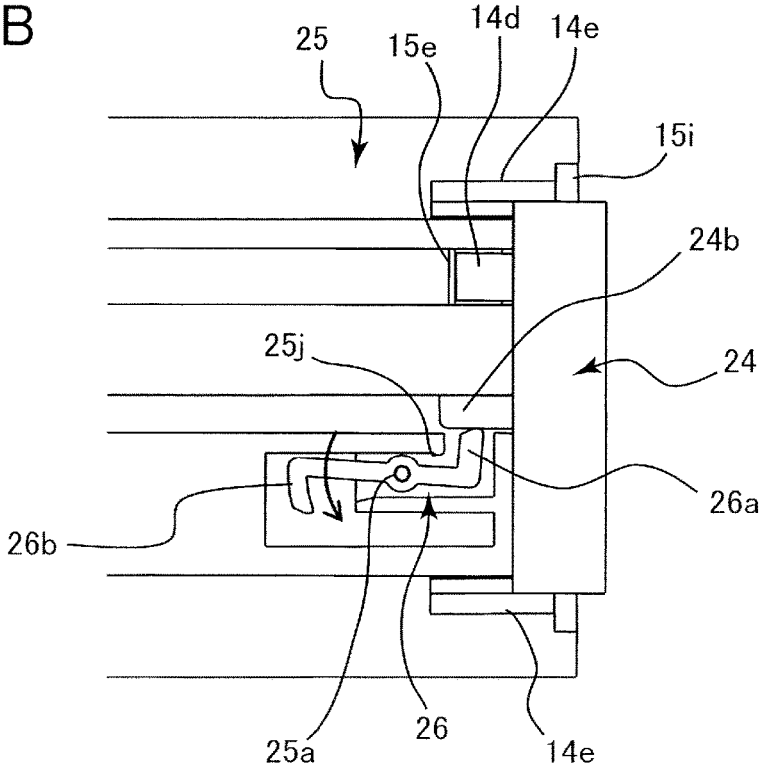
FIG. 17B is an enlarged plan view illustrating the sheet feeding apparatus.

A slide member 25 serving as a slide portion supports the lever 26 serving as an engagement portion and a pivoting member in a pivotable manner by a pivot shaft 25*a*, as illustrated in FIG. 17B, and the lever 26 is biased in a counterclockwise direction by a spring not shown. The lever 26 includes, as illustrated in FIGS. 17B and 19B, a first end portion 26*a* capable of abutting against a rib 24*b* of a trailing edge regulation member 24 and a stopper 25*j* formed on the slide member 25, and a second end portion 26*b* capable of abutting against a rib 21*a* of a sheet feed tray 21. The first end portion 26*a* and the second end portion 26*b* are mutually arranged on opposite sides with the pivot shaft 25*a* arranged at the center.

(Operation of Trailing Edge Regulating Member)

The trailing edge regulation member 24 as a second regulating portion is capable of moving between a first position and a fourth position, similar to the first embodiment. In the following description, only the portions that differ from the configuration of the first embodiment will be described in detail, and description of configurations similar to the first embodiment are omitted.

In a state where the trailing edge regulation member 24 is positioned at the first position, as illustrated in FIGS. 17A and 17B, the engagement portion 14*e* is abutted against the abutment surface 15*i* of the slide member 25, and the claw portion 14*d* is engaged with the hole 15*e*. In this state, the first end portion 26*a* of the lever 26 is abutted against the rib 24*b* of the trailing edge regulation member 24, and it is separated from the stopper 25*j* of the slide member 25.

Figure 18A:
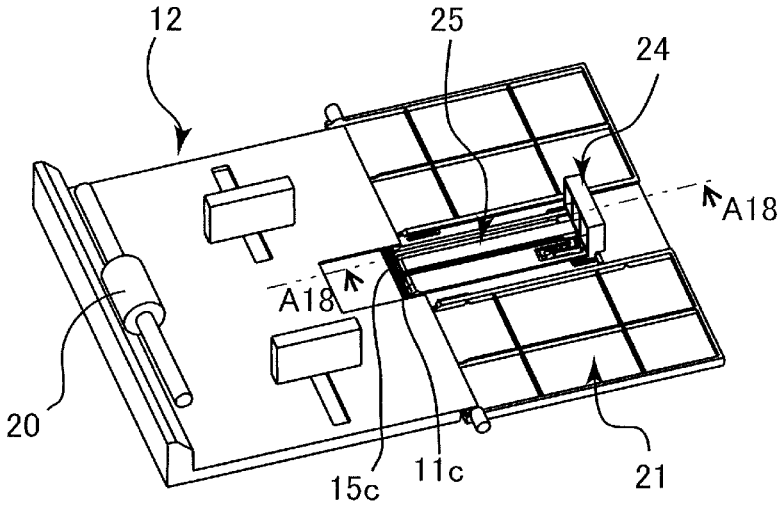
FIG. 18A is a perspective view illustrating a state in which the trailing edge regulation member is positioned at a second position.
Figure 18B:
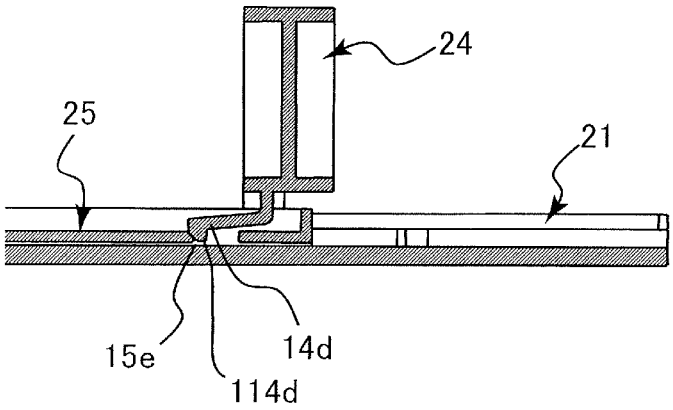
FIG. 18B is a cross-sectional view of cross-section A18-A18 illustrating a state in which the trailing edge regulation member is positioned at the second position.

If the user attempts to move the trailing edge regulation member 24 downstream in the sheet feeding direction, the claw portion 14*d* of the trailing edge regulation member 24 abuts against an edge portion of the hole 15*e*, and the trailing edge regulation member 24 moves integrally with the slide member 25. Then, as illustrated in FIG. 18A, the downstream end 15*c* of the slide member 25 abuts against the abutment surface 11*c* of the sheet feed tray 21 serving as the pivoting portion. At this time, the trailing edge regulation member 24 is positioned at the second position.

Figure 19A:
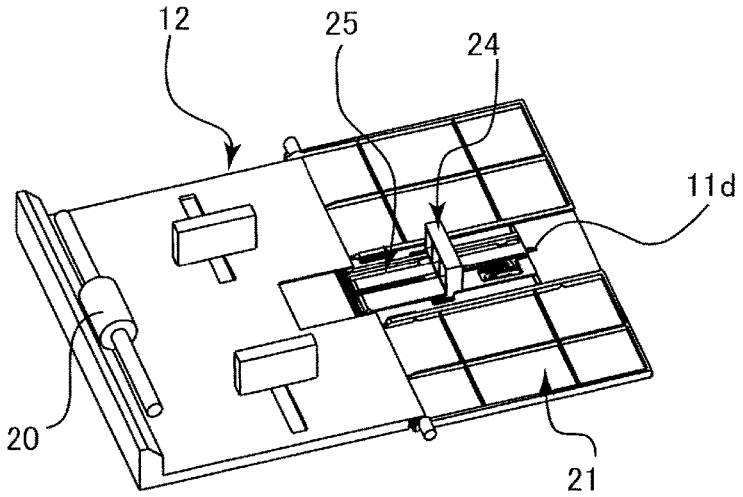
FIG. 19A is a perspective view illustrating a state in which the trailing edge regulation member is moving above a slide member.
Figure 19B:
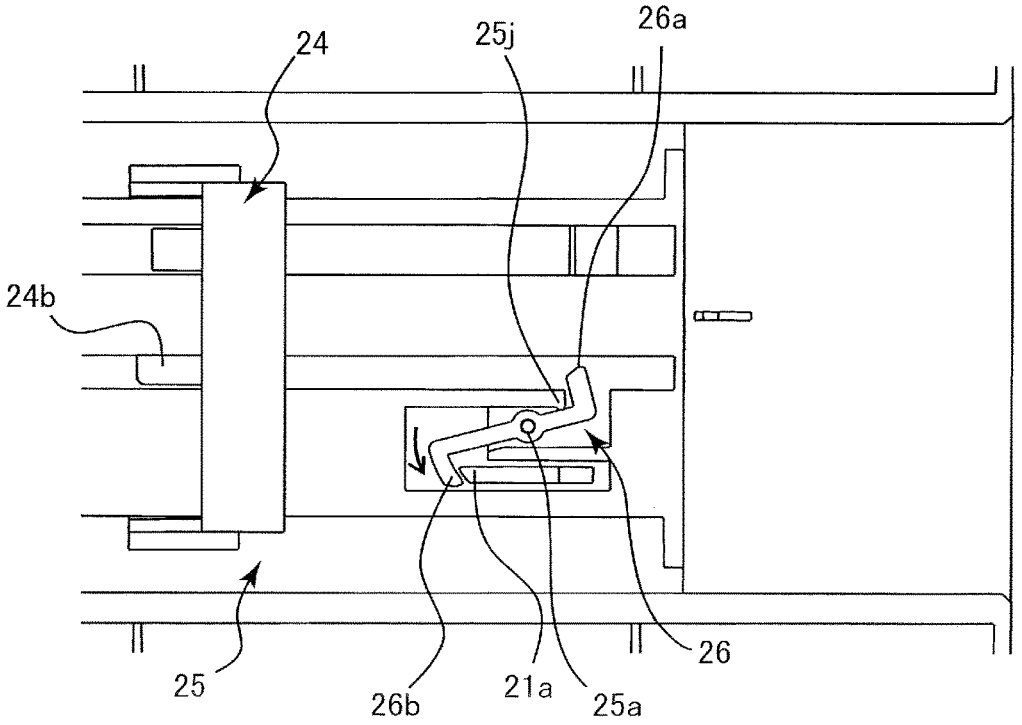
FIG. 19B is a plan view illustrating a state in which the trailing edge regulation member is moving above the slide member.

If the user attempts to move the trailing edge regulation member 24 further downstream in the sheet feeding direction, the claw portion 14*d* of the trailing edge regulation member 24 is disengaged from the hole 15*e*, and as illustrated in FIG. 19A, only the trailing edge regulation member 24 moves. Then, as illustrated in FIG. 19B, the first end portion 26*a* of the lever 26 is separated from the rib 24*b* of the trailing edge regulation member 24, and the lever 26 pivots in the counterclockwise direction by a spring not shown. The first end portion 26*a* of the lever 26 stops in a state abutted against the stopper 25*j* of the slide member 25, and at this time, the second end portion 26*b* of the lever 26 is opposed to the rib 21*a* of the sheet feed tray 21 in the sheet feeding direction. Thereby, the upstream movement of the slide member 25 in the sheet feeding direction is regulated by the rib 21*a*.

Figure 20:
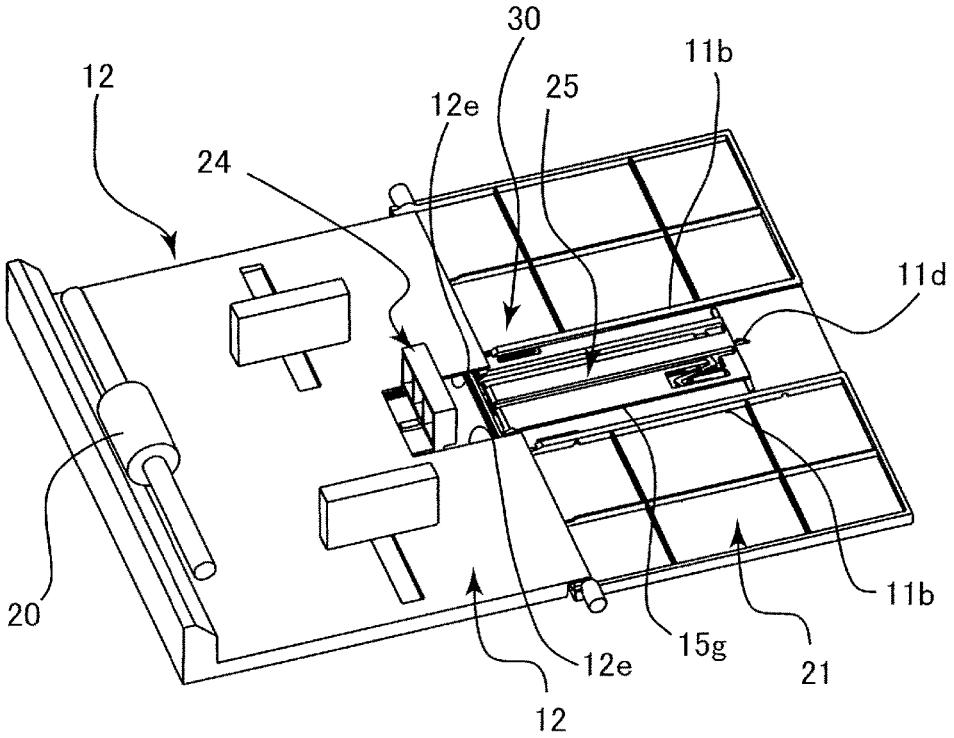
FIG. 20 is a perspective view illustrating a state in which the trailing edge regulation member is positioned at a fourth position.

Then, the trailing edge regulation member 24 passes the third position and is transferred from the guide portion 15*g* of the slide member 15 to the guide portion 12*e* of the bottom plate 12, and as illustrated in FIG. 20, the member 24 is moved to the fourth position. In order to move the trailing edge regulation member 24 upstream in the sheet feeding direction from the fourth position toward the first position, the rib 24*b* of the trailing edge regulation member 24 presses the first end portion 26*a* of the lever 26, and engagement between the second end portion 26*b* and the rib 21*a* is released.

As described above, the lever 26 can lock and release the slide member 25 to and from the sheet feed tray 21, and the trailing edge regulation member 24 can be moved continuously from the first position to the fourth position by a simple configuration. Therefore, even if a sheet whose trailing edge does not reach the sheet feed tray 11, such as a postcard-size sheet, is placed on the bottom plate 12, the trailing edge position of the sheet can be regulated certainly without having to remove the trailing edge regulation member 14 from the sheet feed tray 11.

Since the slide member 25 and the lever 26 are formed of separate components, the slide member 25 and the lever 26 can be formed of different materials, and freedom of design can be improved. For example, the slide member 25 can be formed of a material having a high stiffness to support sheets, and the lever 26 can be formed of a material having a high slidability such that the lever can pivot.

In the second embodiment, the lever 26 is arranged visible to the user, but the lever 26 can be arranged on an inner side of the slide member 25 such that the lever 26 does not contact the sheet. Thereby, rate of occurrence of conveyance failure can be reduced, and appearance can be improved.

The embodiments described above have been described with respect to the printer 100 adopting an electro-photographic system, but the present invention is not restricted to this example. For example, the present invention can be applied to an image forming apparatus adopting an ink-jet system in which liquid ink is discharged through a nozzle to form an image on a sheet. Further, the trailing edge regulation member 14 is not restricted to regulating an upstream end position in the sheet feeding direction. Further, the trailing edge regulation member 14 can regulate the position of edges of the sheet in the sheet width direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-112009 filed Jun. 3, 2016, which is hereby incorporated by reference wherein in its entirety.

What is claimed is:

1. A sheet feeding apparatus comprising:

a body portion comprising a supporting portion configured to support a sheet, and a feed portion configured to feed the sheet supported on the supporting portion;

a pivoting portion arranged upstream in a sheet feeding direction of the supporting portion and supported pivotably between a first position and a second position with respect to the body portion, the pivoting portion being configured to support the sheet together with the supporting portion at the first position;

a slide portion supported slidably on the pivoting portion;

a first regulating portion configured to abut against the slide portion and regulate the slide portion from moving downstream in the sheet feeding direction;

a second regulating portion configured to regulate a position of the sheet supported on the supporting portion; and a guide portion formed across the supporting portion and the slide portion, and configured to guide the second regulating portion between the supporting portion and the slide portion along the sheet feeding direction, the second regulating portion being configured to move on the supporting portion by being guided by the guide portion in a state where the second regulating portion is separated from the slide portion.

2. The sheet feeding apparatus according to claim 1, wherein the first regulating portion is configured to regulate movement of the slide portion such that a downstream end of the slide portion in the sheet feeding direction does not overlap with the supporting portion in a vertical direction.

3. The sheet feeding apparatus according to claim 2, wherein the second regulating portion is configured to regulate a position of an upstream end in the sheet feeding direction of the sheet supported on the supporting portion, and the first regulating portion is formed at a downstream end of the pivoting portion in the sheet feeding direction, and configured to abut against the downstream end of the slide portion.

4. The sheet feeding apparatus according to claim 1, wherein the guide portion comprises a first guide formed on the supporting portion, and a second guide formed on the slide portion, and the second regulating portion is movable between the first guide and the second guide in a state where the slide portion is abutted against the first regulating portion.

5. The sheet feeding apparatus according to claim 4, wherein the pivoting portion is configured to pivot to the second position in a state where an entire portion of the second regulating portion is supported on the first guide.

6. The sheet feeding apparatus according to claim 1, wherein the pivoting portion comprises a first stopper configured to position the slide portion at a first slide position, and a second stopper configured to position the slide portion at a second slide position positioned downstream of the first slide position in the sheet feeding direction.

7. The sheet feeding apparatus according to claim 6, wherein the slide portion comprises an engagement portion configured to engage with the second stopper, and the second regulating portion comprises a release portion configured to press the engagement portion accompanying movement of the second regulating portion in the sheet feeding direction, the second regulating portion releasing an engagement between the engagement portion and the second stopper in a state where the slide portion is positioned at the second slide position.

8. The sheet feeding apparatus according to claim 7, wherein the engagement portion is an elastic member formed integrally with the slide portion, and configured to deform elastically in a direction intersecting with the sheet feeding direction in a state being pressed by the release portion.

9. The sheet feeding apparatus according to claim 7, wherein the engagement portion is a pivoting member supported pivotably on the slide portion, and configured to pivot and release an engagement with the second stopper in a state being pressed by the release portion.

10. The sheet feeding apparatus according to claim 7, wherein the second regulating portion comprises a projecting portion configured to project toward the slide portion, and the slide portion comprises an engaged portion configured to engage with the projecting portion of the second regulating portion in a state where the release portion has released an engagement between the engagement portion and the second stopper.

11. The sheet feeding apparatus according to claim 10, wherein the slide portion and the second regulating portion are configured to move integrally in a state where the projecting portion and the engaged portion are engaged, and the slide portion is not abutted against the first stopper or the second stopper.

12. The sheet feeding apparatus according to claim 7, wherein the pivoting portion comprises a positioning portion configured to position the slide portion at the second slide position in a state where the second stopper is engaged with the engagement portion.

13. An image forming apparatus comprising:

the sheet feeding apparatus according to claim 1; and an image forming portion configured to form an image on a sheet fed by the sheet feeding apparatus.

14. The image forming apparatus according to claim 13, wherein the pivoting portion comprises a surface formed as a sidewall of the image forming apparatus in a state where the pivoting portion is positioned at the second position.

15. A sheet feeding apparatus comprising:

a body portion comprising a supporting portion configured to support a sheet, and a feed portion configured to feed the sheet supported on the supporting portion;

a pivoting portion arranged upstream in a sheet feeding direction of the supporting portion and supported pivotably between a first position and a second position with respect to the body portion, the pivoting portion being configured to support the sheet together with the supporting portion at the first position;

a slide portion supported slidably on the pivoting portion;

a first regulating portion configured to abut against the slide portion and regulate the slide portion from moving downstream in the sheet feeding direction;

a second regulating portion configured to regulate a position of the sheet supported on the supporting portion; and a guide portion formed across the supporting portion and the slide portion, and configured to guide the second regulating portion between the supporting portion and the slide portion along the sheet feeding direction, wherein the guide portion comprises a first guide formed on the supporting portion, and a second guide formed on the slide portion, and the second regulating portion is movable between the first guide and the second guide in a state where the slide portion is abutted against the first regulating portion.

16. The sheet feeding apparatus according to claim 15, wherein the first regulating portion is configured to regulate movement of the slide portion such that a downstream end of the slide portion in the sheet feeding direction does not overlap with the supporting portion in a vertical direction.

17. The sheet feeding apparatus according to claim 16, wherein the second regulating portion is configured to regulate a position of an upstream end in the sheet feeding direction of the sheet supported on the supporting portion, and the first regulating portion is formed at a downstream end of the pivoting portion in the sheet feeding direction, and configured to abut against the downstream end of the slide portion.

18. The sheet feeding apparatus according to claim 15, wherein the pivoting portion comprises a first stopper configured to position the slide portion at a first slide position, and a second stopper configured to position the slide portion at a second slide position positioned downstream of the first slide position in the sheet feeding direction.

19. The sheet feeding apparatus according to claim 18, wherein the slide portion comprises an engagement portion configured to engage with the second stopper, and the second regulating portion comprises a release portion configured to press the engagement portion accompanying movement of the second regulating portion in the sheet feeding direction, the second regulating portion releasing an engagement between the engagement portion and the second stopper in a state where the slide portion is positioned at the second slide position.

20. An image forming apparatus comprising:

the sheet feeding apparatus according to claim 15; and an image forming portion configured to form an image on a sheet fed by the sheet feeding apparatus.

* * * * *